United States Patent [19]

Kusanagi

[11] Patent Number: 5,067,401

[45] Date of Patent: Nov. 26, 1991

[54] MOISTENING WATER SUPPLY APPARATUS FOR PRINTING PRESS

[75] Inventor: Hiroaki Kusanagi, Numazu, Japan

[73] Assignee: Toshiba Kikai Kabushiki Kaisha, Tokyo, Japan

[21] Appl. No.: 433,782

[22] Filed: Nov. 8, 1989

[30] Foreign Application Priority Data

Nov. 10, 1988 [JP] Japan ..... 63-285211

[51] Int. Cl.[5] ..... B41F 7/26; B41F 7/32

[52] U.S. Cl. ..... 101/148; 101/350

[58] Field of Search ..... 101/147, 148, 350, 348, 101/349, 450.1, 132.5, 363, 364

[56] References Cited

U.S. PATENT DOCUMENTS 3,146,706 9/1964 Tonkin et al. ..... 101/148

4,944,223 7/1990 Ikeda ..... 101/148

OTHER PUBLICATIONS

McGraw Hill, Dictionary of Scientific and Technical Terms, 1974, p. 1609.

*Primary Examiner*—J. Reed Fisher

*Attorney, Agent, or Firm*—Cushman, Darby & Cushman

[57] ABSTRACT

Disclosed is a moistening water supply apparatus for a printing press. The apparatus includes, between a moistening water tank and the printing cylinder of the press, a rubber roller and a moistening roller. Each of the rubber roller and the moistening roller is formed of a certain rubber material whereby the angle $\alpha$ at which the rubber roller contacts water is made smaller than the angle $\beta$ at which the moistening roller contacts water. The rubber material contains a prescribed surface active agent added thereto in accordance with necessity.

7 Claims, 2 Drawing Sheets

MOISTENING WATER SUPPLY APPARATUS FOR PRINTING PRESS

BACKGROUND OF THE INVENTION

1. Field of the Invention

The present invention relates to a moistening water supply apparatus for a printing press which is used in an offset press to supply moistening water to the plate cylinder.

2. Description of the related Art

In general, in an offset press, an oil ink is coated and applied in an even thickness by an inking roller on and to the surface of a printing cylinder on which lipophilic printing images such as characters, patterns, and the like to be printed are formed together with hydrophilic non-image portions. The characters and the like on the printing cylinder are transferred to a rubber cylinder, and they are thereafter transferred to printing paper. Prior to the inking of the cylinder plate, water is supplied to the hydrophilic portions, i.e., the non-image portions of the cylinder plate so that these portions will not be inked during the subsequent inking process. The supply of water is normally effected from a water draw-up roller partially dipped in water in a moistening water tank, through a water transfer roller which is a rubber roller, then through a water smoothing roller formed of a metal, finally to a moistening roller of which at least the surface portion is formed of a rubber layer.

A rubber, which is used to form such a water transfer roller or a moistening roller, is inherently a strongly lipophilic material. With such a moistening roller, therefore, a phenomenon known as ink catching occurs, in which part of the ink which has failed to transfer from the printing cylinder to the rubber cylinder moves to the moistening roller. When a certain amount of ink has adhered to the moistening roller in this way, the ink separates from the moistening roller, and moves, through the water smoothing roller, to the water transfer roller, hence, to the water draw-up roller as well, finally reaching the moistening water tank. During this movement of the ink, an ink catching phenomenon also occurs in the water transfer roller which is, similarly to the moistening roller, a rubber roller.

When the above-described ink catching phenomenon occurs in the moistening water supply rollers, particularly, in the water transfer roller, this leads to various problems. For instance, the water repellency of the ink causes a shortage in the amount of water supplied to the water transfer roller, hence, a shortage in the amount of water received by the moistening water. Also, the amount of water may vary in the widthwise (i.e., axial) direction. Such shortages or variations in the amount of water lead to inadequate reproduction of the printing images and the non-image portions on the plate, which in turn causes the formation of blurs, or a degradation in the printing quality. Thus, it has been necessary to apply some suitable measures.

To meet this requirement, an apparatus such as that shown in FIG. 2 has been proposed. As shown in FIG. 2, a printing cylinder 1 is disposed in contact with a rubber cylinder 3 for transferring a predetermined printing image to printing paper 2, and also in contact with an inking roller 11 of an ink supply apparatus 10. The printing cylinder 1 is also in contact with, at its position upstream of the position of its contact with the inking roller 11, a moistening roller 26 of a moistening water supply apparatus. The moistening roller 26 is supplied with water in the following manner. A part of water stored in the moistening water tank 21 is drawn up by a water draw-up roller 22. A part of the drawn-up water is squeezed from the draw-up roller 22 by a rider roller 23. The remaining water on the roller 22 is supplied through a water transfer roller 24 and a water smoothing roller 25 to the moistening roller 26. A bridge roller 31 is disposed between and in contact with the moistening roller 26 and the inking roller 11, so that ink adhered to the moistening roller 26 is returned by the bridge roller 31 to the inking roller 11.

However, the apparatus shown in FIG. 2 fails to overcome the problem that ink separated from the moistening roller 26 moves through the water smoothing roller 25 to the water transfer roller 24.

The ink-catching phenomenon in a moistening water supply apparatus is not solely attributable to the lipophilic property of a rubber material used to form a moistening roller, but it is also related to the lipophilic property of a rubber material used to form a water transfer roller, which is also a rubber roller, and which is positioned upstream of the moistening roller. However, no specific report has hitherto been made concerning the prevention of the ink-catching phenomenon as viewed in connection with the relationship between the moistening roller and a rubber roller positioned upstream of the moistening roller.

SUMMARY OF THE INVENTION

An object of the present invention is to provide a moistening water supply apparatus for a printing press which is capable of preventing any degradation in the printing quality resulting from the ink-catching phenomenon.

The present invention has been accomplished on the basis of the following finding. When a degradation in the printing quality results from the ink-catching phenomenon, the adhesion of ink to the moistening roller is not the sole, main cause. What is important is that whether any ink adheres to a rubber roller positioned upstream of the moisture roller. According to the present invention, the water wettability (i.e., hydrophilic property) of a rubber roller, which is positioned closer to a moistening water tank than a moistening roller is, is greater than the water wettability of the moistening roller. Specifically, when the angle at which the rubber roller contacts water is represented as $\alpha$, while the angle at which the moistening roller contacts water is represented as $\beta$, these angles satisfy the relationship of $\alpha<\beta$ so that the water wettability of the rubber roller is greater than that of the moistening roller.

Thus, when a rubber roller positioned upstream of the moistening roller, for instance, a water transfer roller contacts water at a very small angle, for instance, at an angle which is substantially zero, the roller contacts ink at a large angle, thereby making it possible to prevent the adhesion of ink to the water transfer roller, which is a rubber roller, hence, to prevent the ink-catching phenomenon. Consequently, even when ink has moved from the moistening roller toward the rubber roller, since the ink does not adhere to the surface of the rubber roller, no ink hinders the adhesion of water to the surface of the rubber roller. As a result, the moistening roller can be supplied with an adequate amount of water, while reducing the risk of any ink adhering to the moistening roller. The entire apparatus is therefore capable of preventing any degradation in the printing quality.

DETAILED DESCRIPTION OF THE PREFERRED EMBODIMENT

Figure 1:
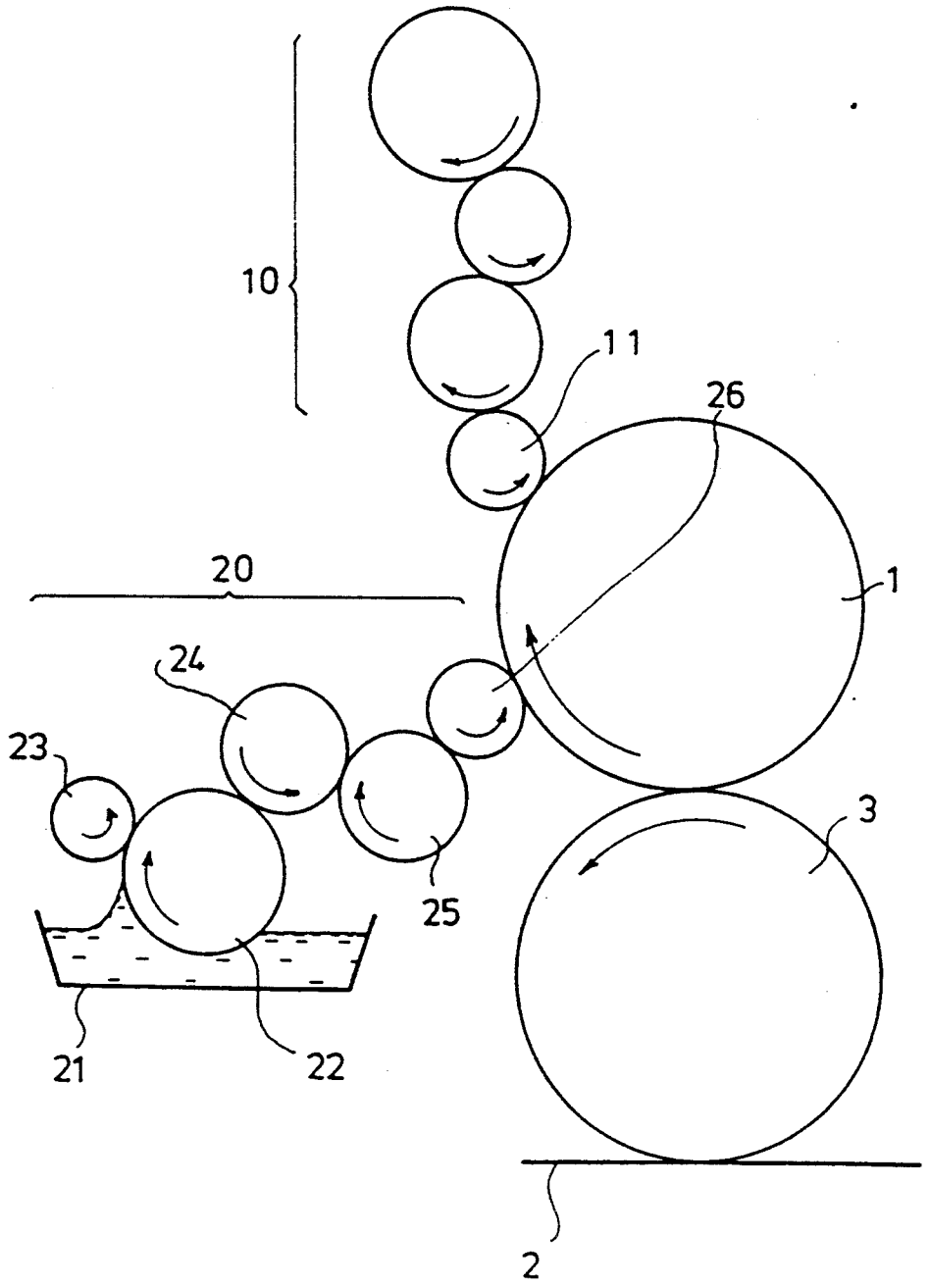
FIG. 1 is a view schematically showing the structure of essential parts of a common printing press in which a moistening water supply apparatus in accordance with the present invention is used.

The preferred embodiment of the present invention will now be described with reference to FIG. 1. In the drawing, the component parts which are the same as or correspond to those of the prior art shown in FIG. 2 are denoted by the same reference numerals.

Figure 2:
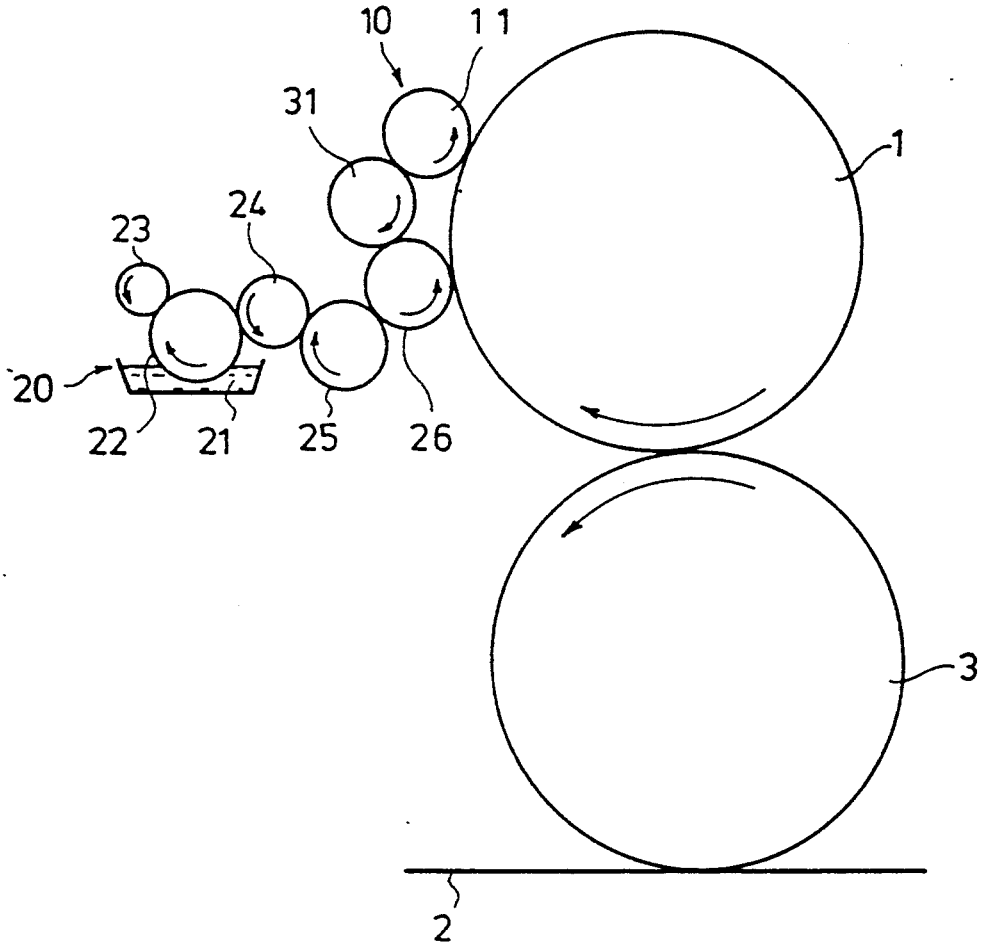
FIG. 2 is a view schematically showing the structure of prior art in which a bridge roller is used.

FIG. 1 schematically show a portion of a common offset press where a moistening water supply apparatus in accordance with the present invention is located. As shown in the figure, the printing press has a printing cylinder 1, and rubber cylinder 3 to which ink is transferred from the printing cylinder 1 so as to print a predetermined image onto printing paper 2. An ink supply apparatus 10 having an inking roller 11 and plurality of other rollers, as well as a moistening water supply apparatus 20 are disposed on the periphery of the printing cylinder 1. These apparatuses 10 and 20 are disposed in such a manner that the moistening water supply apparatus 20 is positioned upstream of the ink supply apparatus 10 in the direction in which the printing cylinder 1 rotates.

The moistening water supply apparatus 20 has a water draw-up roller (source roller) 22 partially dipped in water or an aqueous solution stored in a moistening water tank 21, a rider roller 23 for adjusting the amount of water drawn up by the water draw-up roller 22, a water transfer roller 24 disposed in contact with the water draw-up roller 22, a water smoothing roller 25 which is disposed in contact with the water transfer roller 24 and is capable of rotating about its axis while reciprocating in the axial direction so as to uniform the thickness of the film of water, and a moistening roller 26 disposed in contact with the water smoothing roller 25, and also in contact with the printing cylinder 1. Among these rollers 22 to 26, each of the water draw-up roller 22 and the water smoothing roller 25 is a roller formed of a metal material such as brass, which is, when required, plated with hydrophilic chromium. On the other hand, each of the rider roller 23, the water transfer roller 24, and the moistening roller 26 is a roller (rubber roller) of which at least the surface portion is formed of a rubber layer.

Materials which may be used to form the rubber layers of the water transfer roller 24 and the moistening roller 26, these being rubber rollers, include nitrile-butadiene rubber (NBR), styrene-butadinene rubber (SBR), chloroprene rubber (CR), silicone rubber, urethane rubber, and polyvinyl chloride (PVC) rubber. Among these, preferred is NBR which is inexpensive and is available with ease, while possessing a low level of water swelling property. The rubber material used to form the rubber layers may contain either a prescribed amount of a surface active agent added thereto, or no surface active agent, so that the wettability of the water transfer roller 24 and the moistening roller 26 is set to suitable levels. Specifically, the amount of the surface active agent is set in such a manner that, when the angle at which the water transfer roller 24 contacts water is represented as $\alpha$, while the angle at which the moistening roller 26 contacts water is represented as $\beta$, the relationship of $\alpha<\beta$ is satisfied.

Materials which may be used as the surface active agent include: nonionic surface active agents such as alpha olefin-based-, higher alcohol-based-, and straight-chain alkylbenzene-based-nonionic surface active agents; anionic surface active agents; catinonic surface active agents; and ampholytic surface active agents. Among these surface active agents, nonionic surface active agents are preferred.

With the above-described construction, when the printing press is driven, the printing cylinder 1 is rotated, while both the ink supply apparatus 10 and the moistening water supply apparatus 20 are driven. In the moistening water supply apparatus 20, as the water draw-up roller 22 is driven, the roller 22 draws up water from the moistening water tank 21. A part of the drawn-up water is squeezed from the roller 22 by the rider roller 23 so that the amount of the water is adjusted. The water remaining on the water draw-up roller 22 is transferred by the water transfer roller 24 to the water smoothing roller 25, on which the rotation and the axial movement of the roller 25 cause the water to be evenly dispersed in the axial direction of the roller 25. Thereafter, the water moves to the moistening roller 26. The water on the moistening roller 26 adheres to the surface to the printing cylinder 1 before the process of inking the printing cylinder 1. Specifically, the water enters and stays in recessed portions of the surface of the printing cylinder 1, that is, the recesses allowing the formation of half-tone dots, and the water moves, the cylinder 1 rotates, toward the ink supply apparatus 10. The ink supply apparatus 10 operates in such a manner that the inking roller 11 applies ink to portions of the surface of the printing cylinder 1 which are not recessed and which will form the half-tone dots. The ink applied to the printing cylinder 1 is transferred to the rubber cylinder 3, and it is thereafter transferred to printing paper 2, thereby completing a printing process.

According to the above-described embodiment of the present invention, the following advantages are provided.

During a printing process, the water transfer roller 24 which is upstream of the moistening roller 26, in other words, which is closer to the moistening water tank 21 than the moistening roller 26 is exhibits an adequate level of water wettability by virtue of the action of the surface active agent Therefore, if a portion of the ink applied to the printing cylinder 1 has not transferred to the rubber cylinder 3 to remain on the periphery of the printing cylinder 1, even when the ink moves through the moistening roller 26 and the water smoothing roller 25 toward the water transfer roller 24, it is possible to prevent the ink from transferring to the water transfer roller 24, thereby preventing the occurrence of the ink-catching phenomenon in the transfer roller 24. This enables the water transfer roller 24 to maintain its function for a long period.

Further, since the water transfer roller 24 is thus kept free from the adhesion of ink thereto, and, as stated before, it is allowed to exhibit a certain level of water wettability by the action of the surface active agent, the water transfer roller 24 can be supplied with an adequate amount of water from the water draw-up roller 22, thereby preventing any shortage in the amount of water supplied to the moistening roller 26. This enables, in addition to the water transfer roller 24, the moistening roller 26 to always have its surface wet, whereby the adhesion of ink to the moistening roller 26 is restricted, and the risk of the occurrence of the ink-catching phenomenon is reduced.

According to the present invention, therefore, the printing quality can be maintained at its level uninfluenced by the ink-catching phenomenon.

Next, explanations will be given with reference to FIG. 1, concerning the proportion at which various component materials are used in each of the water transfer roller 24 and the moistening roller 26 of apparatus in accordance with the present invention, and concerning the angle of contact of the rollers 24 and 26 with water (i.e., wetting angle) as well as the angle of their contact with ink.

TABLE 1

| | No. 1 | No. 2 | No. 3 | No. 4 | No. 5 | No. 6 |
|---|---|---|---|---|---|---|
| NBR | 100 | 100 | 100 | 100 | 100 | 100 |
| ZINC FLOWER | 5 | 5 | 5 | 5 | 5 | 5 |
| VULCANIZING AGENT | 6 | 6 | 6 | 6 | 6 | 6 |
| DIOCTYL PHTHALATE (DOP) | 20 | 20 | 20 | 20 | 20 | 20 |
| FACTICE (VULCANIZING OIL) | 20 | 20 | 20 | 20 | 20 | 20 |
| INORGANIC PIGMENT | 5 | 5 | 5 | 5 | 5 | 5 |
| NONIONIC SURFACE ACTIVE AGENT | 0 | 1 | 3 | 5 | 7 | 10 |
| ANGLE OF CONTACT | | | | | | |
| WATER | 110* | 92* | 88* | 51* | 0* | 0* |
| INK | 44* | 37* | 35* | 38* | 72* | 86* |

*In the table, the proportion of the components is expressed in terms of parts by weight It will be understood by referring to Table 1 that, if the amount of the surface active agent added is adjusted, the angle of contact of the rollers with water can be adjusted to any values, and that an increase in the amount of the surface active agent added causes an improvement in the water wettability. It is said that, in general, water repellency is exhibited when a roller is in contact with water at an angle of 90 or greater, whereas hydrophilic property is exhibited when the roller is in contact with water at an angle of less than 90. However, in order to achieve the so-called wet state of the roller, the angle of contact must be 30 to 40 or smaller.

The mount of the surface active agent added to the water transfer roller 24 should not be less than 1 part by weight, preferably not less than 5 parts by weight, and more preferably not less than 7 parts by weight. If the surface active agent is added in an extremely great amount, for instance, in an amount of not less than 15 parts by weight, this may result in a bleeding phenomenon in which part of the surface active agent bleeds out to the surface of the roller, or may make the machining of the roller impossible. Thus, there is naturally an upper limit to the amount in which the surface active agent may be added. On the other hand, if this mount is less than 1 part by weight, the angle of contact cannot be reduced to a very small angle, thereby failing to achieve adequate prevention of the adhesion of ink to the water transfer roller 24.

The amount of the surface active agent added to the moistening roller 26 should be less than 5 parts by weight, preferably be less than 3 parts by weight, and more preferably be less than 1 part by weight. If the surface active agent is added in an amount of not more than 5 parts by weight, the angle of contact of the moistening roller 26 with water becomes so small as to supply an excessive amount of water to the printing cylinder 1. If such is the case, part of the water on the cylinder 1 may move to the inking roller 11, and it may hinder the action of the inking roller 11, i.e., the inking of the printing cylinder 11, thereby leading to a phenomenon known in the field of printing as "ink peeling-off". In any case, the surface active agent to be used in the moistening roller 26 must be added in such a manner that the angle $\alpha$ at which the water transfer roller 24 contacts water will be smaller than the angle $\beta$ at which the moistening roller 26 contacts water (i.e. $\alpha<\beta$). On the assumption that the water supply apparatus is used in a printing press with a currently known structure, a suitable amount of the surface active agent used in the water transfer roller 24 is an amount not less than 5 parts by weight, while a suitable amount of the surface active agent used in the moistening roller 26 is an amount less than 1 part by weight.

EXAMPLE

Explanations will be given of a test conducted using the water transfer roller 24 and the moistening roller 26 of the apparatus in accordance with the present invention, and under the conditions shown in Table 2.

TABLE 2

| | |
|---|---|
| PRINTING PRESS | Offset press produced by Toshiba Machine Co., Ltd. |
| PRINTING INK | "Wave Z World", a product of Dainippon Ink and Chemicals, Inc. |
| MOISTENING WATER SUPPLY APPARATUS | Continuous water supply apparatus (See FIG. 1) |
| WATER SUPPLY ROLLER | Amount of surface active agent used: 0 |
| MOISTENING ROLLER | Amount of surface active agent used: 3 parts by weight |
| MOISTENING WATER | 10 v/v (volume) %-isopropyl alcohol aqueous solution |
| PRINTING PERIOD | 8 hours |

In the above-described test, even though the operation of the apparatus continued for 8 hours, it was observed that no ink-catching phenomenon occurred in the water transfer roller 24, thereby making it possible to maintain the printing quality at the required level after the operation for 8 hours. When 10 parts by weight of the surface active agent was used in the water transfer roller 24, a similar result was obtained.

Another test was conducted in which printing was performed under the same conditions as those shown in FIG. 2, except that no surface active agent was added to the rubber layer of the water transfer roller 24. As a result, when 2 hours had passed from the start of the test, the moistening roller 26 encountered the ink-catching phenomenon, thereby failing to maintain the printing quality at the required level.

From these tests, it will be understood that the combination of the water transfer roller 24 and the moistening roller 26 of the apparatus in accordance with the present invention is effective enough to prevent ink catching.

The above-described example shows that good results are provided if the water transfer roller 24 and the moistening roller 26 are incorporated in a common, conventionally known moistening supply apparatus, and simultaneously if the amount of the surface active agent added to the rubber layer of the water transfer roller 24 is not less than 7 parts by weight while the corresponding amount in the rubber layer of the moistening roller 26 is zero. However, the proportion at which the surface active agent may be used in each of the rollers 24 and 26 according to the present invention is not limited to these values, but the proportion varies in accordance with various factors. If the water wettability of all the rollers from the water draw-up roller 22 to the water smoothing roller 25 of the moistening water supply apparatus 10 is changed, the amount of the surface active agent added to the rubber layer of each of the water transfer roller 24 and the moistening roller 26 is changed accordingly. In any case, the angle $\alpha$ of contact of the water transfer roller 24 must be smaller than the angle $\beta$ of contact of the moistening roller 26, i.e., $\alpha<\beta$ must stand, so as to improve the water wettability of the water transfer roller 24. The rollers in the moistening water supply apparatus may not necessarily consist of five rollers, as shown in FIG. 1, and they may alternatively consist of three or any other number of rollers. With such a different arrangement, the amount of the surface active agent added to each of the rollers 24 and 26 varies. This amount also varies in accordance with the proportion of the printing images of the printing cylinder 1 to the non-image portions thereof, i.e., the ratio of figures and patterns to be printed.

Although in the foregoing description, the water transfer roller 24 serves as the rubber roller whose wettability is improved according to the present invention, a different roller may alternatively serve as the rubber roller in so far as it is a rubber roller which is positioned closer to the moistening water tank 21 than the moistening roller 26 is.

Furthermore, improvement in the wettability of the rubber roller may not necessarily be achieved by the addition of a surface active agent, but may be achieved in a different way.

As has been described above, with the moistening water supply apparatus in accordance with the present invention, it is possible to prevent the occurrence of an ink-catching phenomenon in the water transfer roller, thereby enabling the printing quality to be assured for a long period of time.

What is claimed is:

1. A printing apparatus, comprising:

a printing cylinder;

means for applying ink to said printing cylinder;

water storage means;

a transfer roller having at least a surface portion formed of a rubber material;

means for applying water, including at least one roller, from said water storage means to said transfer roller;

a moistening roller; and means, including at least one roller, for supplying water from said transfer roller to said moistening roller, a surface of said moistening roller being solely in contact with said printing cylinder and said supply means and separate from said means for applying ink;

said transfer roller supplying water to said moistening roller, said moistening roller supplying water to said printing cylinder, said surface of said transfer roller and said surface of said moistening roller having different hydrophilic properties so as to cause a water contact angle of said transfer roller to be less than a water contact angle of said moistening roller so that the water wetability of said transfer roller is greater than the water wetability of said moistening roller.

2. A moistening water supply apparatus for a printing press according to claim 1, wherein each of said transfer roller and said moistening roller is formed, at least in part, of one rubber material selected from the group consisting of nitrile-butadiene rubber, styrene-butadiene rubber, chloroprene rubber, silicone rubber, urethane rubber, and polyvinyl chlorine rubber.

3. A moistening water supply apparatus for a printing press according to claim 2, wherein said rubber material contains a surface active agent added thereto so as to achieve the desired wetability of each of said transfer roller and said moistening roller.

4. A moistening water supply apparatus for a printing press according to claim 2, wherein each of said transfer roller and said moistening roller has a surface layer, at least said surface layer being formed by the rubber material.

5. A moistening water supply apparatus for a printing press according to claim 3, wherein said surface active agent is selected from the group consisting of nonionic surface active agents including alpha olefin-based-, alcohol-based- and straight-chain alkylbenzene-based-nonionic surface active agents, anionic surface active agents, cationic surface active agents, and ampholytic surface active agents.

6. A moistening water supply apparatus for a printing press according to claim 3, wherein said surface active agent contained in said rubber associated with said transfer roller is of an amount of not less than 1 part by weight.

7. A moistening water supply apparatus for a printing press according to claim 3, wherein said surface active agent contained in said rubber associated with said moistening roller is of an amount of less than 5 parts by weight.

* * * * *